US007341503B2

(12) United States Patent
Huang

(10) Patent No.: US 7,341,503 B2
(45) Date of Patent: Mar. 11, 2008

(54) SURFACE TREATING METHOD FOR GOLF CLUB HEAD

(75) Inventor: Chun-Yung Huang, Kaohsiung Hsien (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 249 days.

(21) Appl. No.: 11/298,690

(22) Filed: Dec. 12, 2005

(65) Prior Publication Data

US 2007/0135025 A1 Jun. 14, 2007

(51) Int. Cl.
*B24B 1/00* (2006.01)

(52) U.S. Cl. ..... 451/54; 451/59; 451/61

(58) Field of Classification Search ..... 451/54, 451/59, 61, 27, 28; 148/516
See application file for complete search history.

(56) References Cited

U.S. PATENT DOCUMENTS 5,195,743 A * 3/1993 Walsh, Jr. ..... 473/401
5,269,513 A * 12/1993 Gervais ..... 473/408
5,377,986 A 1/1995 Viollaz et al.
5,787,539 A * 8/1998 Nussbaum ..... 15/24
6,112,364 A * 9/2000 Myers ..... 15/236.08
2002/0183132 A1 12/2002 Said et al.
2003/0092505 A1 5/2003 Liou

FOREIGN PATENT DOCUMENTS

TW 187916 7/1992

* cited by examiner

*Primary Examiner*—Dung Van Nguyen
(74) *Attorney, Agent, or Firm*—Birch, Stewart, Kolasch & Birch, LLP

(57) ABSTRACT

A surface treating method for a golf club head includes applying polishing pretreatment on a golf club head and grinding at least one surface of the golf club head with a resilient grinding rod. The resilient grinding rod includes at least one resilient matrix and at least one kind of grinding particles. The resilient matrix is resin or rubber. The resilient matrix has a hardness within a range of Shore A 70 and Shore D 80. The resilient grinding rod includes a grinding end that possesses an inclined grinding face having inclination with an angle θ with respect to a longitudinal axis of the grinding rod.

19 Claims, 4 Drawing Sheets

SURFACE TREATING METHOD FOR GOLF CLUB HEAD

BACKGROUND OF THE INVENTION

1. Field of the Invention

The present invention relates to a surface treating method. More particularly, the present invention relates to a surface treating method for a golf club head.

2. Description of Related Art

Taiwan Utility Model Publication No. 187916 discloses a surface treating method for golf club heads. As illustrated in FIGS. 1 and 2 of the drawings, golf club heads 91 are placed into a grinding cylinder 92 containing grinding fluid. A plurality of grinding particles 921 are added into the grinding fluid for impacting and rubbing the surfaces of the golf club heads 91 during various operations (such as rolling or vibration) of the grinding cylinder 92. The grinding fluid is thus stirred and churned to thereby proceed with grinding on the surfaces of the golf club heads 91. In practical use, the grinding particles 921 are selected from particles inevitably having large diameters such that the corner areas "a" (the area between the striking plate 911 and the sole 912), "b" (the area between the crown 913 and the striking plate 911), and "c" (the area between the sole 912 and the back plate 914) each only possessing a narrowed space could not be processed by the large diameters of the grinding particles. Further, overgrinding and overimpacting occur in the other areas of the golf club head while insufficient grinding occurs in these, corner areas "a", "b", and "c" where the operational space is limited. Further, such a method can be only used to treat the whole open surface of the golf club head, i.e., local surface treating of the golf club head could not be obtained at the corner areas.

OBJECTS OF THE INVENTION

An object of the present invention is to provide a surface treating method for a golf club head to improve the grinding effect of the surface of the golf club head.

Another object of the present invention is to provide a surface treating method for a golf club head to allow grinding on corner areas of the golf club head.

SUMMARY OF THE INVENTION

A surface treating method for a golf club head in accordance with the present invention comprises applying polishing pretreatment on a golf club head and grinding at least one surface of the golf club head with a resilient grinding rod. The resilient grinding rod comprises at least one resilient matrix and at least one kind of grinding particles. The resilient matrix is resin or rubber. The resilient matrix has a hardness within a range of Shore A 70 and Shore D 80. The resilient grinding rod comprises a grinding end.

Preferably, the surface of the golf club head has a maximum surface roughness $R_{max}$ smaller than 25 μm after the step of applying polishing pretreatment on a golf club head.

Preferably, the resilient matrix is selected from the group consisting of polyurethane, thermoplastic elastomers, unsaturated polyesters, polyethylene terephthalate resin, epoxy resins, polyethylene, polypropylene, polyamide, acrylic resin, polybutadiene resin, styrene butadiene copolymers and combinations thereof.

Preferably, the grinding particles are selected from the group consisting of garnet powder, aluminum oxide, cerium dioxide, silicon dioxide, zirconium oxide, diamond, sapphire, boron nitride, boron carbide, silicon carbide, and combinations thereof.

Preferably, the grinding particles have an average diameter a range of 60 meshes/square inches and 400 meshes/square inches.

Preferably, the golf club head comprises a back cavity of undercut type.

Preferably, the resilient grinding rod grinds at least one corner of the back cavity.

Preferably, the surface of the golf club head has a maximum surface roughness $R_{max}$ ranging between 7 μm and 1 μm after the step of grinding at least one surface of the golf club head.

In an example, the grinding end of the resilient grinding rod is an ordinary cone for proving an inclined grinding surface.

In another example, the grinding end of the resilient grinding rod is an oblique cone, and the grinding end has a tip mis-aligned with a longitudinal axis of the resilient grinding rod.

In a further example, the grinding end of the resilient grinding rod comprises a cutting face for proving an inclined grinding surface, and wherein the grinding end has a tip misaligned with a longitudinal axis of the resilient grinding rod.

Preferably, the grinding end comprises an inclined grinding face that is at an angle within a range of 15-75 degrees with a longitudinal axis of the resilient grinding rod.

Other objects, advantages and novel features of this invention will become more apparent from the following detailed description when taken in conjunction with the accompanying drawings.

DETAILED DESCRIPTION OF THE PREFERRED EMBODIMENTS

Figure 3:
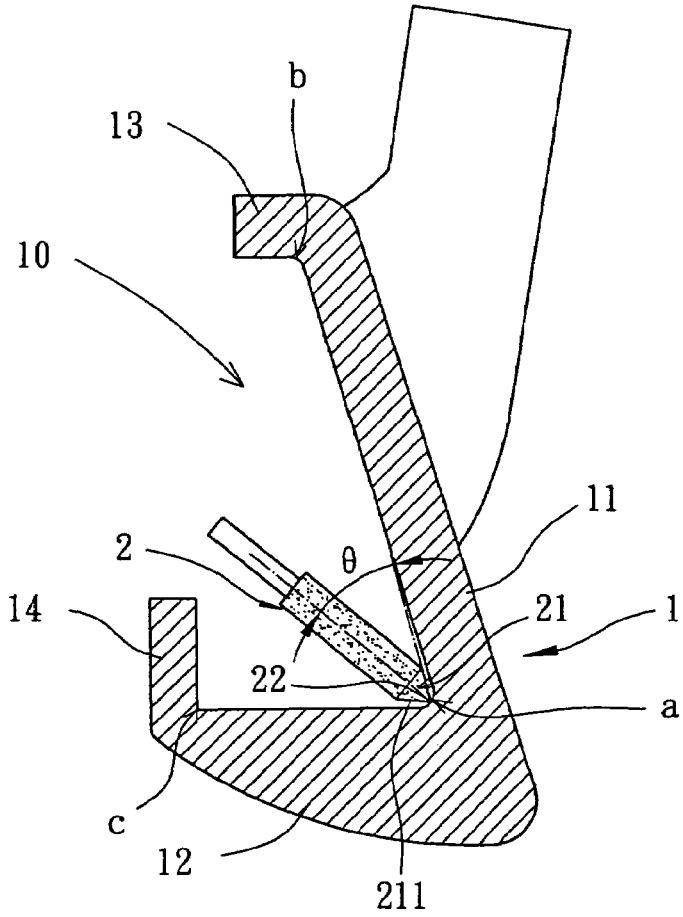
FIG. 3 is a sectional view illustrating surface treatment with a method in accordance with the present invention.

Referring to FIG. 3, a surface treating method in accordance with the present invention comprises applying polishing pretreatment on a golf club head 1 and grinding at least one surface of the golf club head 1 with a resilient grinding rod 2.

The maximum surface roughness $R_{max}$ of the golf club head 1 after the polishing pretreatment is preferably smaller than 25 μm, and more preferably smaller than 10 μm.

The resilient grinding rod 2 comprises at least one resilient matrix and at least one kind of grinding particles. The resilient grinding rod 2 includes a resilient grinding end 21 that is an ordinary cone and that has an inclined grinding face 211 at an angle θ with a longitudinal axis of the grinding rod 2. The resilient grinding end 21 includes a point 22 located on longitudinal axis of the grinding rod 2.

The golf club head 1 may be selected from an iron, wood, utility, or putter. The illustrated example of the golf club head 1 is an iron comprising a striking plate 11, a sole 12, a crown 13, and a back plate 14, with a back cavity 10 of undercut type being delimited between the striking plate 11, the sole 12, and the back plate 14.

Still referring to FIG. 3, the resilient grinding rod 2 is preferably mounted on a portable rotary machine or a table of an automated machine which can rotate the resilient grinding rod 2. The resilient matrix of the resilient grinding rod 2 is preferably resin or rubber that is suitable for polishing treatment. More preferably, the resilient matrix is selected from the group consisting of polyurethane, thermoplastic elastomers, unsaturated polyesters, polyethylene terephthalate resin, epoxy resins, polyethylene, polypropylene, polyamide, acrylic resin, polybutadiene resin, styrene butadiene copolymers and combinations thereof.

The hardness of the resilient matrix is preferably within a range of Shore A 70 and Shore D 80. In addition to the resilient matrix, the grinding particles are preferably selected from the group consisting of garnet powder, aluminum oxide, cerium dioxide, silicon dioxide, zirconium oxide, diamond, sapphire, boron nitride, boron carbide, silicon carbide, and combinations thereof. Preferably, the grinding particles have an average diameter ranging between 60 meshes/square inches and 400 meshes/square inches. In other words, the average diameter of the grinding particles is ranging between 35 μm and 250 μm.

By using the resilient matrix and the grinding particles mentioned above, the grinding rod 2 is resiliently deformable while providing the required grinding effect. Further, the angle θ between the inclined grinding face 211 and the longitudinal axis of the grinding rod 2 is preferably within a range of 15-75 degrees, more preferably within a range of 40-60 degrees.

Figure 2:
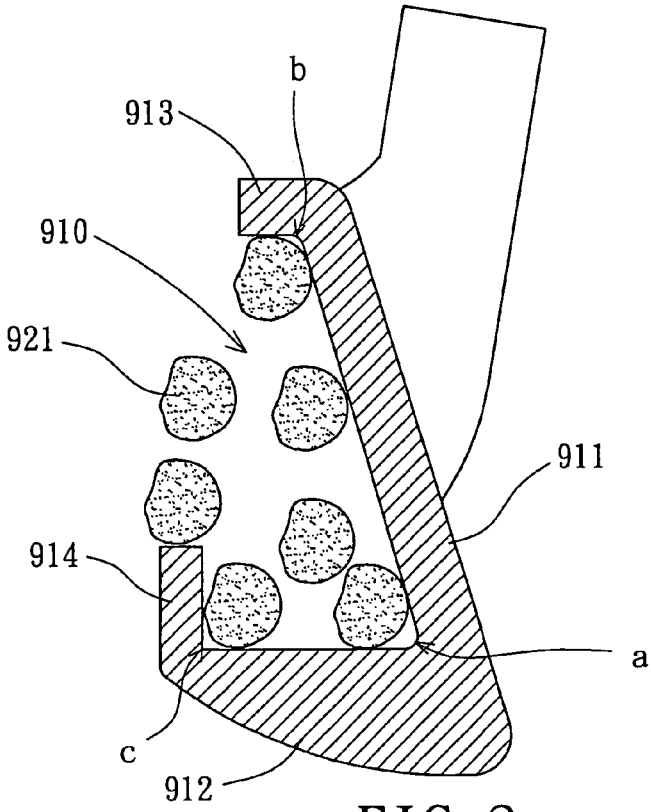
FIG. 2 PRIOR ART
FIG. 2 is a sectional view illustrating surface treatment of a golf club head in the conventional grinding device.

Still referring to FIG. 3, when applying the surface treating method in accordance with the present invention on the golf club head 1, the resilient grinding rod 2 rotates about its longitudinal axis to directly grind the surface of the golf club head 1. Since the grinding rod 2 has a resilient grinding end 21, it is particularly useful in grinding the inner faces delimiting the back cavity 10 of the golf club head 1. The corner areas "a", "b", "c" (see FIG. 2) of the back cavity 10 of the golf club head 1 can be ground effectively without causing overgrinding on the other areas of the golf club head 1. The surface of the golf club head 1 after grinding by the grinding rod 2 may have a satin, matting, or shadowy effect. The maximum surface roughness $R_{max}$ of the surface of the golf club head 1 is smaller than 25 μm, preferably ranging between 10 μm and 0.5 μm, and most preferably ranging between 7 μm and 1 μm after the step of grinding operation.

Figure 4:
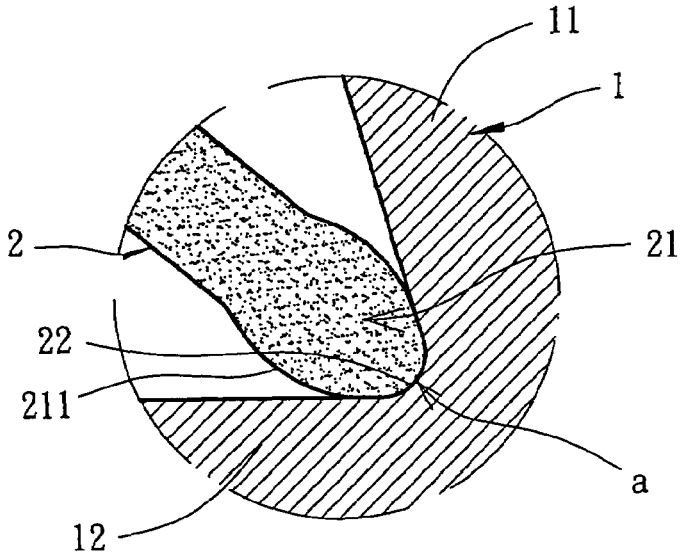
FIG. 4 is an enlarged view of a portion in FIG. 3.

Owing to the resiliency of the resilient grinding rod 2, when the resilient grinding end 21 of the resilient grinding rod 2 comes in contact with the golf club head 1 (particularly in the corner areas "a", "b", and "c"), the resilient grinding end 21 is compressed and thus deforms elastically (see FIG. 4). Namely, the resilient grinding end 21 is more round, and the resilient grinding end 21 and a peripheral area of the grinding rod 2 adjacent to the resilient grinding end 21 expand outward to increase the contact area and grinding area between the surface of the golf club head 1 and the resilient grinding rod 2. The grinding effect in the corner areas "a", "b", and "c" is improved.

The point 22 of the resilient grinding rod 2 may be used to provide patterns on the surface of the golf club head 1. Further, the point 22 would not result in a rough surface in the corner areas "a", "b", and "c", as the grinding rod 2 is resilient. In a case that the inclined grinding face 22 is used to grind the surface of the golf club head 1, the resultant surface has fewer patterns and is brighter. The diameter of the resilient grinding rod 2 is preferably 3-9 mm, more preferably 4-8 mm.

Figure 5:
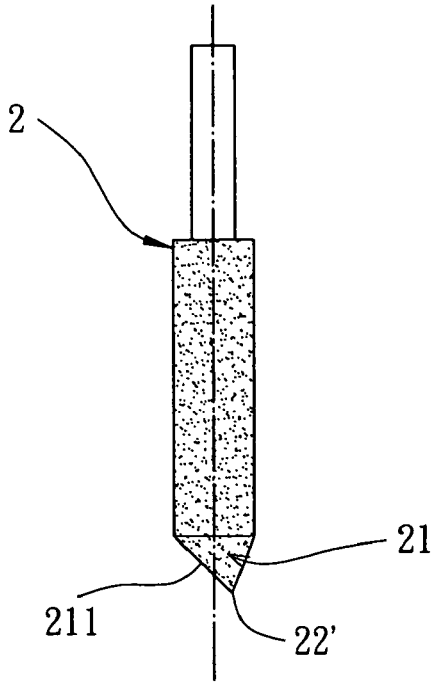
FIG. 5 is a side view of a modified embodiment of a grinding rod in accordance with the present invention.

FIG. 5 illustrates a modified embodiment of the resilient grinding rod 2 that includes a grinding end 21 that is an oblique cone with a point 22' mis-aligned with the longitudinal axis of the resilient grinding rod 2, which is different from the design in the embodiment shown in FIG. 3 in which the point 22 is located on the longitudinal axis of the resilient grinding rod 2.

Figure 1:
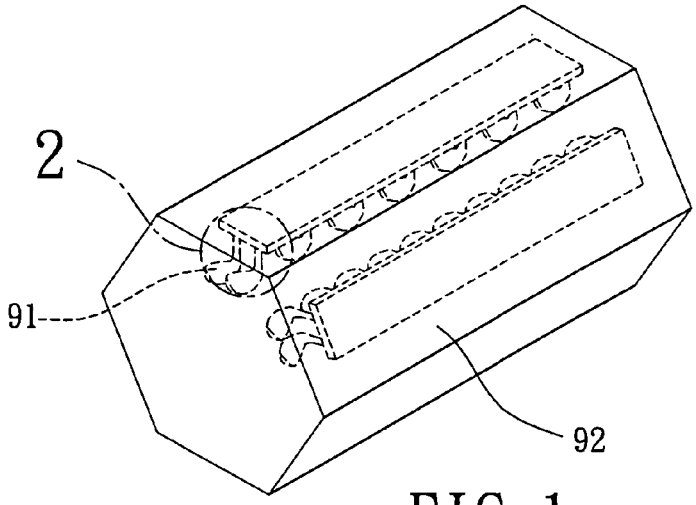
FIG. 1 PRIOR ART
FIG. 1 is a perspective view of a conventional grinding device for treating surfaces of golf club heads.
Figure 6A:
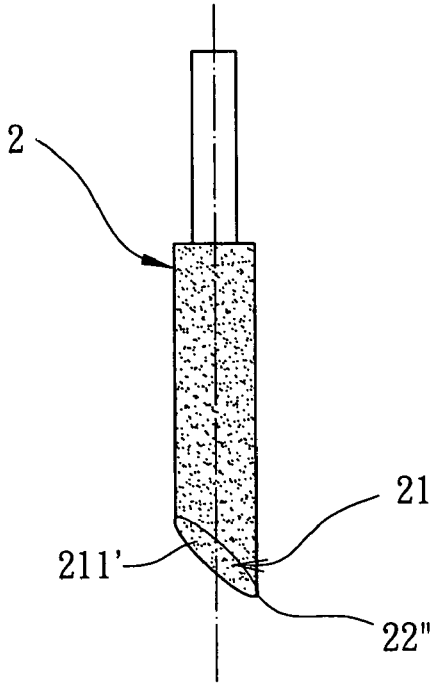
FIG. 6A is a side view of another modified embodiment of the grinding rod in accordance with the present invention.
Figure 6B:
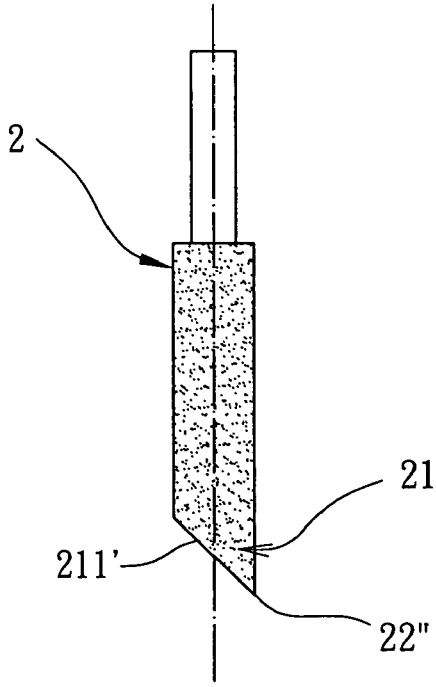
FIG. 6B is another side view of the grinding rod in FIG. 6A.

FIGS. 6A and 6B illustrate another modified embodiment of the resilient grinding rod 2. In this embodiment, the grinding end 21 of the resilient grinding rod 2 includes a cutting face that forms an inclined grinding face 211'. The grinding end 21 includes a point 22" that is mis-aligned with the longitudinal axis of the resilient grinding rod 2. The grinding rod 2 shown in FIG. 1 is suitable to have an ordinary grinding path on the surface of the golf club head 1. The grinding rods 2 shown in FIGS. 5, 6A, and 6B are more suitable to provide a ground surface with a satin, matting, or shadowy effect. Further, different grinding ends 21 can be used according to the product needs.

Referring back to FIGS. 3 through 6B, the resilient grinding rod 2, disclosed in the first through third embodiments, is constructed from the resilient matrix suitable for grinding such that the resilient grinding rod 2 can apply uniform polishing treatment on a predetermined area or the entire area of the surface of the golf club head 1. In particular, the grinding end 21 of the resilient grinding rod 2 can carry out effective polishing treatment on the surface of the corner areas "a", "b", "c" of the golf club head 1 such that the higher grinding quality of the golf club head 1 is obtained. In addition, the grinding end 21 of the resilient grinding rod 2 possesses the inclined grinding face 211, 211' having inclination with an angle θ with respect to a longitudinal axis of the grinding rod 2. In grinding operation, the corner areas "a", "b", "c" of the golf club head 1 permit extension of the grinding end 21 of the resilient grinding rod 2 for polishing treatment so that a dead point of polishing treatment on the corner areas "a", "b", "c" of the club head 1 can be avoided.

Figure 7:
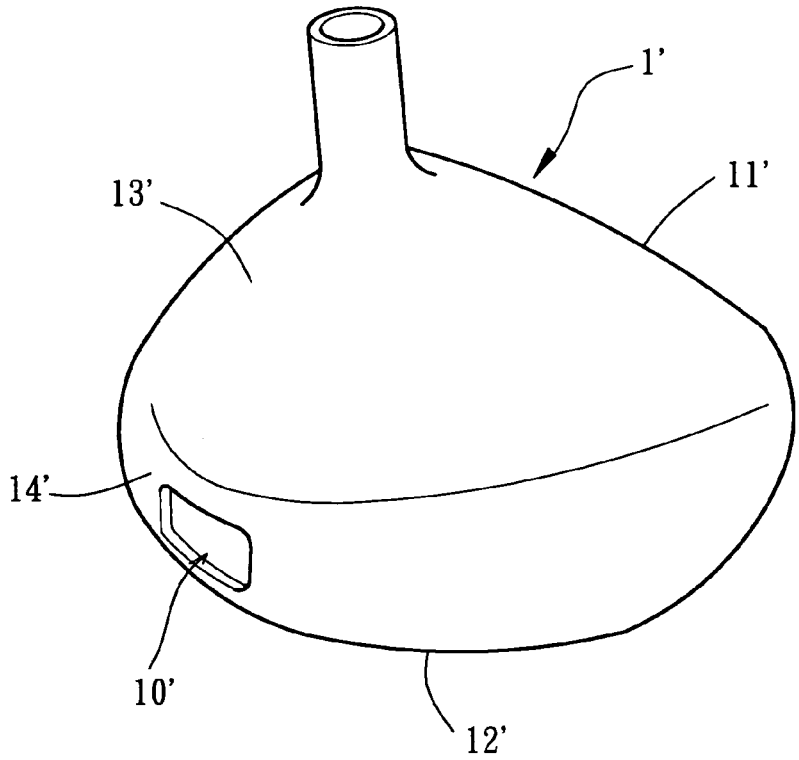
FIG. 7 is a perspective view illustrating a wood-type club head having a recess portion suitable for the surface treating method in accordance with the present invention.

Referring to FIG. 7, a wood-type club head having a recess portion suitable for the surface treating method in accordance with the present invention is illustrated. In this embodiment, the golf club head 1' is a wood-type club head comprising a striking plate 11', a sole 12', a crown 13', and a rear side wall 14'. The rear side wall 14' of the golf club head 1' is formed with a recess portion 10' which has several corner areas where operational spaces are limited. In an alternative embodiment, a predetermined position of the surface of the golf club head 1' is provided several recess portions which have various sizes and depths.

Figure 8:
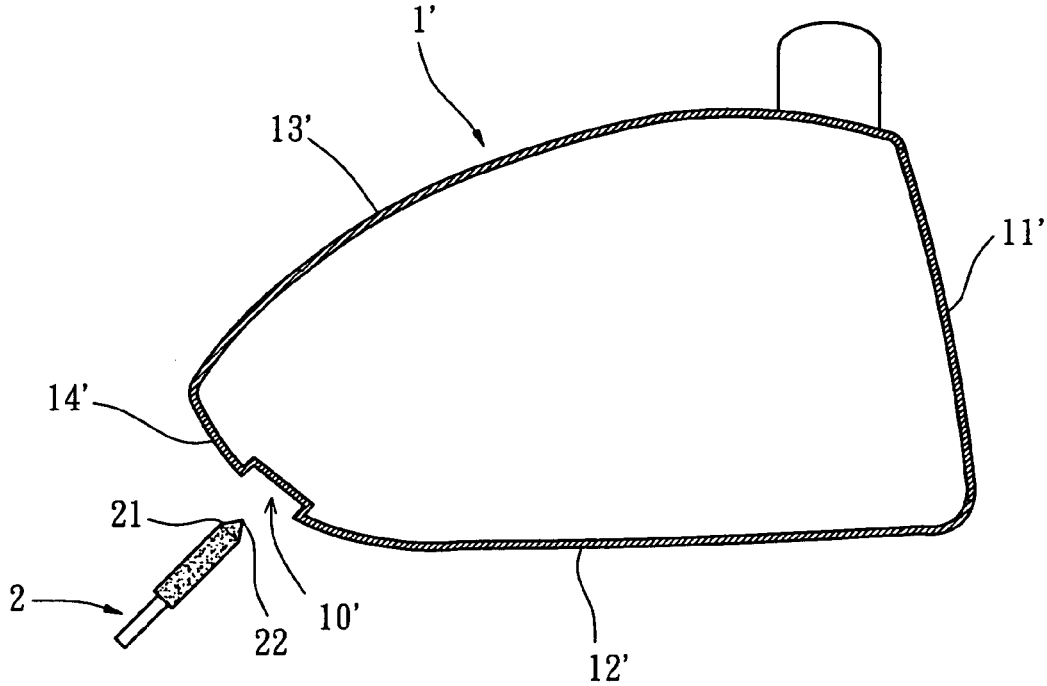
FIG. 8 is a sectional view of the grinding rod applied to the recess portion of the wood-type club head in accordance with the present invention.

Turning now to FIG. 8, a sectional view of the grinding rod applied to the recess portion of the wood-type club head in accordance with the present invention is illustrated. In surface treating operation, the corner areas of the recess portion 10' of the golf club head 1' permit insertion of the point 22 of the grinding end 21 of the resilient grinding rod 2. Accordingly, the grinding end 21 of the resilient grinding rod 2 is designed to implement the perfect surface treating operation in the corner areas of the recess portion 10' of the golf club head 1'.

Referring back to FIG. 5, in an alternative embodiment, the point 22' of the grinding end 21 of the resilient grinding rod 2 can be applied to implement the perfect surface treating operation in the corner areas of the recess portion 10' of the golf club head 1' if desired. Consequently, the inclined grinding face 211 of the resilient grinding rod 2 can create particular patterns (not shown) on the surface of the golf club head 1' with respect to the recess portion 10' of the golf club head 1' according to the design need.

Referring back to FIGS. 6A and 6B, in another embodiment, the point 22" of the grinding end 21 of the resilient grinding rod 2 can be applied to implement the perfect surface treating operation. Consequently, the inclined grinding face 211' of the resilient grinding rod 2 can also create particular patterns (not shown) on the surface of the golf club head 1' with respect to the recess portion 10' of the golf club head 1'.

As has been discussed above, in conventionally grinding operation, the sizes of the grinding particles 921 cannot be specifically minimized to grind the surface of the corner areas "a", "b", "c" of the golf club head 91 where the operation space is limited, as best shown in FIG. 1. As a result, the grinding particles 921 cannot effectively grind the surface of the corner areas "a", "b", "c" of the golf club head 91 in the event so that dead points of polishing treatment may occur in the corner areas "a", "b", "c" of the golf club head 91. Conversely, the resilient grinding rod 2 is constructed from the combination of the resilient matrix and the grinding particles for improving the effect of polishing treatment in the corner areas "a", "b", "c" of the back cavity 10 of the golf club head 1. In grinding operation, the grinding end 21 of the resilient grinding rod 2 can contact with the surface of the corner areas "a", "b", "c" of the golf club head 1 such that dead points and poor quality of polishing treatment can be avoided.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A surface treating method for a golf club head, comprising:

applying polishing pretreatment on a golf club head on which having at least one corner; and grinding at least one surface of the corner of the golf club head with a resilient grinding rod;

wherein the resilient grinding rod comprises at least one resilient matrix and at least one kind of grinding particles;

wherein said at least one resilient matrix is resin or rubber;

wherein said at least one resilient matrix has a hardness within a range of Shore A 70 and Shore D 80; and wherein the resilient grinding rod comprises a grinding end including an inclined grinding face for use in grinding the corner of the golf club head.

2. The surface treating method as claimed in claim 1, wherein said at least one surface of the golf club head has a maximum surface roughness $R_{max}$ smaller than 25 μm after the step of applying polishing pretreatment on a golf club head.

3. The surface treating method as claimed in claim 1, wherein the resilient matrix is selected from the group consisting of polyurethane, thermoplastic elastomers, unsaturated polyesters, polyethylene terephthalate resin, epoxy resins, polyethylene, polypropylene, polyamide, acrylic resin, polybutadiene resin, styrene butadiene copolymers and combinations thereof.

4. The surface treating method as claimed in claim 1, wherein the grinding particles are selected from the group consisting of garnet powder, aluminum oxide, cerium dioxide, silicon dioxide, zirconium oxide, diamond, sapphire, boron nitride, boron carbide, silicon carbide, and combinations thereof.

5. The surface treating method as claimed in claim 1, wherein the grinding particles have an average diameter ranging between 60 meshes/square inches and 400 meshes/square inches.

6. The surface treating method as claimed in claim 1, wherein the golf club head comprises a back cavity of undercut type.

7. The surface treating method as claimed in claim 6, wherein the resilient grinding rod grinds at least one corner of the back cavity.

8. The surface treating method as claimed in claim 1, wherein said at least one surface of the golf club head has a maximum surface roughness $R_{max}$ ranging between 7 μm and 1 μm after the step of grinding at least one surface of the golf club head.

9. The surface treating method as claimed in claim 1, wherein the grinding end of the resilient grinding rod is an ordinary cone.

10. The surface treating method as claimed in claim 1, wherein the grinding end of the resilient grinding rod is an oblique cone for providing the inclined grinding surface, and wherein the grinding end has a tip mis-aligned with a longitudinal axis of the resilient grinding rod.

11. The surface treating method as claimed in claim 1, wherein the grinding end of the resilient grinding rod comprises a cutting face, and wherein the grinding end has a tip mis-aligned with a longitudinal axis of the resilient grinding rod.

12. The surface treating method as claimed in claim 1, wherein the inclined grinding face has an angle within a range of 15-75 degrees with a longitudinal axis of the resilient grinding rod.

13. A surface treating method for a golf club head, comprising:

applying polishing pretreatment on a wood-type golf club head on which having at least one recess portion with at least one corner; and grinding the corner of the golf club head with a resilient grinding rod;

wherein the resilient grinding rod comprises at least one resilient matrix and at least one kind of grinding particles;

wherein said at least one resilient matrix is resin or rubber;

wherein said at least one resilient matrix has a hardness within a range of Shore A 70 and Shore D 80; and wherein the resilient grinding rod comprises a grinding end including an inclined grinding face for use in grinding the corner of the golf club head.

14. The surface treating method as claimed in claim 13, wherein the resilient matrix is selected from the group consisting of polyurethane, thermoplastic elastomers, unsaturated polyesters, polyethylene terephthalate resin, epoxy resins, polyethylene, polypropylene, polyamide, acrylic resin, polybutadiene resin, styrene butadiene copolymers and combinations thereof.

15. The surface treating method as claimed in claim 13, wherein the grinding particles are selected from the group consisting of garnet powder, aluminum oxide, cerium dioxide, silicon dioxide, zirconium oxide, diamond, sapphire, boron nitride, boron carbide, silicon carbide, and combinations thereof.

16. The surface treating method as claimed in claim 13, wherein the grinding end of the resilient grinding rod is an ordinary cone.

17. The surface treating method as claimed in claim 13, wherein the grinding end of the resilient grinding rod is an oblique cone for providing the inclined grinding surface, and wherein the grinding end has a tip misaligned with a longitudinal axis of the resilient grinding rod.

18. The surface treating method as claimed in claim 13, wherein the grinding end of the resilient grinding rod comprises a cutting face, and wherein the grinding end has a tip mis-aligned with a longitudinal axis of the resilient grinding rod.

19. The surface treating method as claimed in claim 13, wherein the inclined grinding face has an angle within a range of 15-75 degrees with a longitudinal axis of the resilient grinding rod.

* * * * *